United States Patent [19]

Hansen

[11] Patent Number: 4,529,095

[45] Date of Patent: Jul. 16, 1985

[54] PLASTIC CONTAINER

[76] Inventor: Gerhard Hansen, Heerstrasse 20, 7166 Sulzbach-Laufen 2, Fed. Rep. of Germany

[21] Appl. No.: 634,157

[22] Filed: Jul. 25, 1984

[30] Foreign Application Priority Data

Aug. 4, 1983 [DE] Fed. Rep. of Germany ..... 3328158

[51] Int. Cl.[3] ..... B65D 1/02

[52] U.S. Cl. ..... 215/31; 215/331

[58] Field of Search ..... 215/100 R, 31, 32, 331, 215/332, 228

[56] References Cited

U.S. PATENT DOCUMENTS 2,073,067 3/1937 Klein et al. ..... 215/31 X 3,973,941 8/1976 Augeri ..... 215/31 X

FOREIGN PATENT DOCUMENTS 1766974 5/1958 Fed. Rep. of Germany .

1514725 6/1978 United Kingdom .

*Primary Examiner*—Donald F. Norton

*Attorney, Agent, or Firm*—Roylance, Abrams, Berdo & Goodman

[57] ABSTRACT

A plastic container, especially an ampoule, a bottle or the like, has a container neck on which a plug device, particularly a needle holder, can be mounted. The plug device is held on the container, without a special ring or the like, by a holder formed as a unitary part of the container. The holder forms a bayonette connection with a mating part on the plug device.

7 Claims, 5 Drawing Figures

PLASTIC CONTAINER

FIELD OF THE INVENTION

The present invention relates to a container which releasably holds a plug device mounted on the container by a bayonette connection.

BACKGROUND OF THE INVENTION

A known container of this type is disclosed in DE-GM 1 766 974 and comprises a tube and a cap connected to the top of the tube by means of an easily detachable bayonette connection. When the cap is closed, the bayonette connection is inside the tube. A tubular part on the cap extends on the outside of the tube, and serves as a guide on the outside of the tube bead.

A protective sheathing for a hypodermic needle is disclosed in GB-PS 1 514 725. The sheathing can be connected with the needle by a snap connection and is easily detached by pulling. The hypodermic needle can be connected with a syringe by a tapered seat.

SUMMARY OF THE INVENTION

An object of the present invention involves providing a container having a bayonette connection on the outside of the container.

Another object of the present invention is to provide a container which is simple and inexpensive to manufacture.

The foregoing objects are obtained by a container comprising a body, a neck extending from the body along a container axis and a holder formed as a unitary portion of the container for releasably coupling a plug device to the neck. The holder forms a part of a bayonette connection between the neck and the plug device, and includes first and second holder walls on opposite sides of the body. Each holder wall extends substantially parallel to the container axis and has a holding catch on its front portion facing the neck. Each holding catch has a stop surface limiting relative rotation between the holding catches and the plug device.

By forming the container in this manner, the holder is formed on the outside of the container as a special part using waste material from the blow molding process used to manufacture the container with the holder. Only a small change is required on the plug device to form a bayonette connecting part cooperating with the holder on the outside of the container. The holder of the present invention can be used on a container which is filled and closed in one manufacturing process, and on a container which is filled and closed after its manufacture.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF PREFERRED EMBODIMENT

Figure 1:
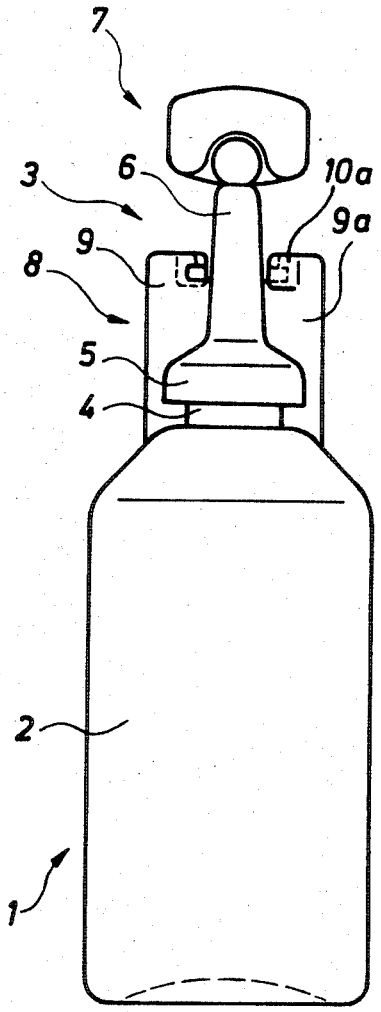
FIG. 1 is a side elevational view of a container according to the present invention.

A container according to the present invention can be an ampoule 1 manufactured by a blow molding process, and then filled and closed. The ampoule comprises a body 2 to hold medication or the like and an ampoule neck 3 on body 2. The neck has a pinched-in part 4, a bell part 5, a conical plug part 6, and a break-off cap 7 on its top. Plug part 6 has a smaller transverse diameter than parts 5 and 6, and tapers upwardly.

A holder 8, formed as a unitary and integral part of ampoule 1, is attached to ampoule neck 3. Holder 8 comprises holder walls 9, 9*a* on opposite sides of the parts 4 and 5 and plug part 6. Holder walls 9 and 9*a* extend from ampoule body 2 approximately to the middle of plug part 6, are essentially flat, and lie in the same plane. Each of the two walls 9, 9*a* has a holding catch 10 or 10*a* directed toward plug part 6 on its end facing break-off cap 7. Each of the catches 10, 10*a* extends diagonally from wall 9 or 9*a*, and has a bottom contact surface 11 or 11*a*. Each contact surface 11, 11*a* comprises a spiral surface portion in the area of wall 9 or 9*a*, followed by a planar or flat surface portion. The portion of control surface 11 or 11*a* adjacent wall 9 or 9*a* lies nearer to break-off cap 7 than the portions spaced from wall 9 or 9*a*. The flat surface portion extends perpendicular to the axis of ampoule 1. A radially inwardly projecting contact part or stop surface 12 or 12*a* is provided at the end of the contact surface 11 or 11*a*.

Figure 3:
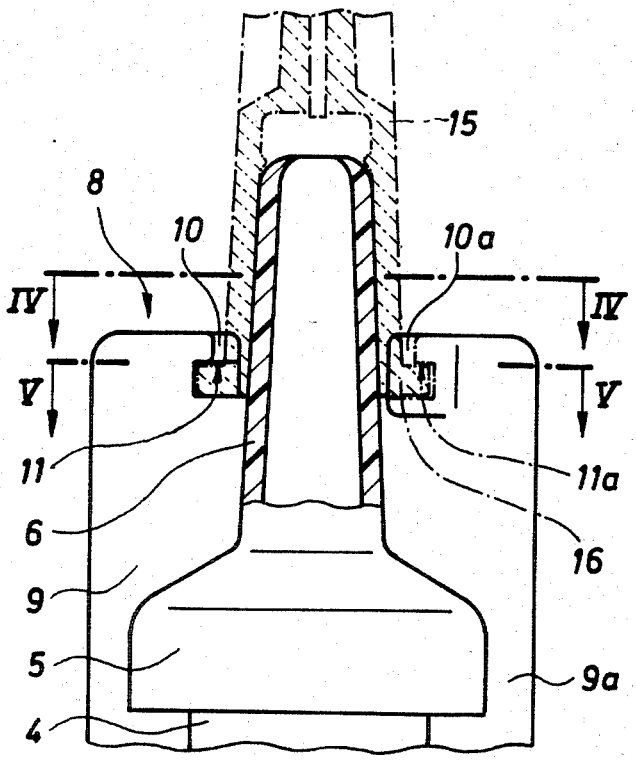
FIG. 3 is a partial, enlarged side elevational view, partially in section, of the container of FIG. 1 with a plug device.
Figure 4:
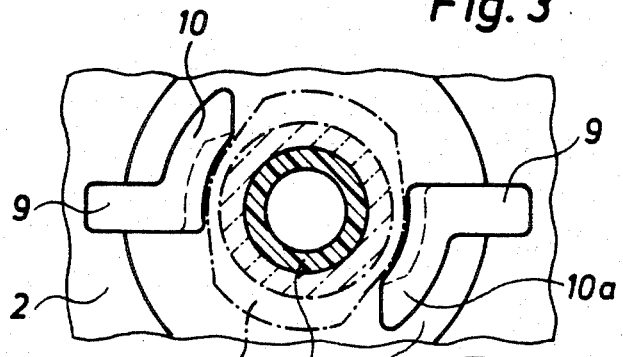
FIG. 4 is a partial top plan view, in section, taken along line IV—IV of FIG. 3, with the plug device in a first position.
Figure 2:
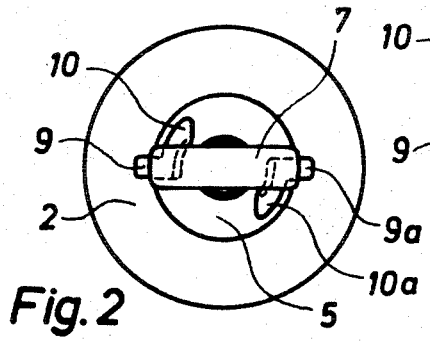
FIG. 2 is a top plan view of the container of FIG. 1.
Figure 5:
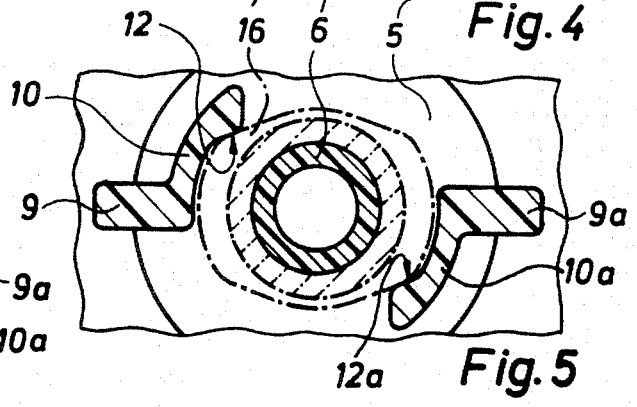
FIG. 5 is a partial top plan view, in section, taken along line V—V of FIG. 3 with the plug device in a second position.

The plug device can be a needle carrier 15 for a hollow needle, particularly an injection needle, shown in FIGS. 3 to 5, and can be mounted onto plug part 6. Needle carrier 15 has a radially outwardly projecting flange 16 at the end of its truncated conical part, configured as shown in FIGS. 4 and 5. By means of flange 16, needle carrier 15 cooperates with holder 8 to provide a bayonette connection therebetween.

Needle carrier 15 is placed onto plug part 6 so that the larger diameter parts of flange 16 lie outside catches 10 and 10*a*, and can be engaged under holding catches 10 and 10*a* following a short rotation. As illustrated in FIG. 4, needle carrier 15 is initially fitted on plug part 6 so that the flange can be brought between catches 10, 10*a*. In FIG. 5, flange 16 is aligned with contact parts or stop surfaces 12 and 12*a* following clockwise rotation of less than 90° from the position illustrated in FIG. 4.

Flange 16 of the needle carrier is configured as a rhombus in plan view with the sharp corners rounded and engageable under holding catches 10, 10*a*. The spiral surface portions on holding catches 10, 10*a* cause needle carrier 15 to be pressed on plug part 6 when the bayonette connection is closed. With flange 16 engaging the flat holder surface portions of holding catches 10 and 10*a*, holder 15 is held more securely than if the flange engages the spiral surface portion in its closed position. Also, the angle relative to the axis of ampoule 1 can be smaller than the angle of internal friction.

Holder 8 for needle carrier 15 is advantageously manufactured in the same manufacturing process as the ampoule and of material which would otherwise be waste material. Holder catches 10, 10*a* are produced by the configuration of the top jaw halves of the mold during forming of ampoule 1, and are brought into the shape shown in the drawings.

Needle carrier 15 can be removed from ampoule 1 by being rotated from the position shown in FIG. 5 counterclockwise to the position shown in FIG. 4, and then raised from plug part 6.

While a particular embodiment has been chosen to illustrate the invention, it will be understood by those skilled in the art that various changes and modifications can be made therein without departing from the scope of the invention as defined in the appended claims.

What is claimed is:

1. A container, comprising:

a body;

a neck extending from said body along a container axis; and holder means, formed as a unitary portion of the container, for releasably coupling said neck to a plug device, said holder means forming one part of a bayonette connection between said neck and the plug device and including first and second holder walls on opposite exterior sides of said neck, each of said holder walls extending substantially parallel to said container axis and having a holding catch on a front portion thereof facing said neck, such said holding catch having a stop surface limiting relative rotation between said holding catches and the plug device.

2. A container according to claim 1 wherein each said holding catch extends peripherally about said neck through an arc not greater than about 90° and spaced from said neck, said stop surfaces being located at ends of said holding catches.

3. A container according to claim 2 wherein each said holding catch comprises a spiral contact surface and a planar contact surface oriented generally perpendicularly to said container axis forming the bayonette connection between said neck and the plug device.

4. A container according to claim 3 wherein said body and neck are formed of plastic, and said holder means are formed as a unitary one-piece member with said neck and said body without seams and welding.

5. A container according to claim 2 wherein said body and neck are formed of plastic, and said holder means are formed as a unitary one-piece member with said neck and said body without seams and welding.

6. A container according to claim 1 wherein said body and neck are formed of plastic, and said holder means are formed as a unitary one-piece member with said neck and said body without seams and welding.

7. A container according to claim 1 wherein a plug device is coupled to said neck, said plug device having a laterally extending flange engaging said holding catches to form the bayonette connection therebetween.

* * * * *